US011524809B2

(12) United States Patent
Mayer

(10) Patent No.: US 11,524,809 B2
(45) Date of Patent: Dec. 13, 2022

(54) WORKING STATION WITH A LIFTING MECHANISM FOR A PACKAGING MACHINE

(71) Applicant: WEBER MASCHINENBAU GMBH BREIDENBACH, Breidenbach (DE)

(72) Inventor: Josef Mayer, Memmingerberg (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 178 days.

(21) Appl. No.: 16/755,477

(22) PCT Filed: Oct. 5, 2018

(86) PCT No.: PCT/EP2018/077071
§ 371 (c)(1),
(2) Date: Apr. 10, 2020

(87) PCT Pub. No.: WO2019/072693
PCT Pub. Date: Apr. 18, 2019

(65) Prior Publication Data

US 2021/0300615 A1 Sep. 30, 2021

(30) Foreign Application Priority Data

Oct. 12, 2017 (DE) ..... 102017123805.0

(51) Int. Cl.
*B65B 65/02* (2006.01)
*B65B 9/04* (2006.01)
(Continued)

(52) U.S. Cl.
CPC ..... *B65B 65/02* (2013.01); *B65B 9/04* (2013.01); *B65B 47/00* (2013.01); *B65B 51/10* (2013.01); *B65B 61/06* (2013.01)

(58) Field of Classification Search
USPC ..... 53/561
See application file for complete search history.

(56) References Cited

U.S. PATENT DOCUMENTS 2,712,717 A 7/1955 Keller
3,993,232 A * 11/1976 White ..... B26D 7/0675 226/68
(Continued)

FOREIGN PATENT DOCUMENTS

DE 2824965 A1 12/1979
DE 10327092 A1 12/2004
(Continued)

OTHER PUBLICATIONS

Official Communication from European Patent and Trademark Office for related International Application No. PCT/EP2018/077071; dated Apr. 26, 2019; 6 pages.
(Continued)

*Primary Examiner* — Chinyere J Rushing-Tucker
(74) *Attorney, Agent, or Firm* — Dickinson Wright PLLC

(57) ABSTRACT

The invention relates to a working station, in particular to a deep-drawing station, to a molding station, to a sealing station, to a cutting station or to a punching station, for a packaging machine, comprising a rack supported on the ground; a work unit comprising an upper part and a lower part; and a lifting mechanism which is carried by the rack and by which the lower part of the work unit can be raised and lowered relative to the rack to perform a lower stroke, wherein the lifting mechanism has a drive that comprises at least one shaft extending in a transverse direction; a drive motor engaging at the shaft for rotating the shaft; and at least one gear which is coupled at an input side to the shaft, at which the lower part is supported at an output side, and which converts a rotation of the shaft into the lower stroke of the lower part.

27 Claims, 6 Drawing Sheets

Figure 1:
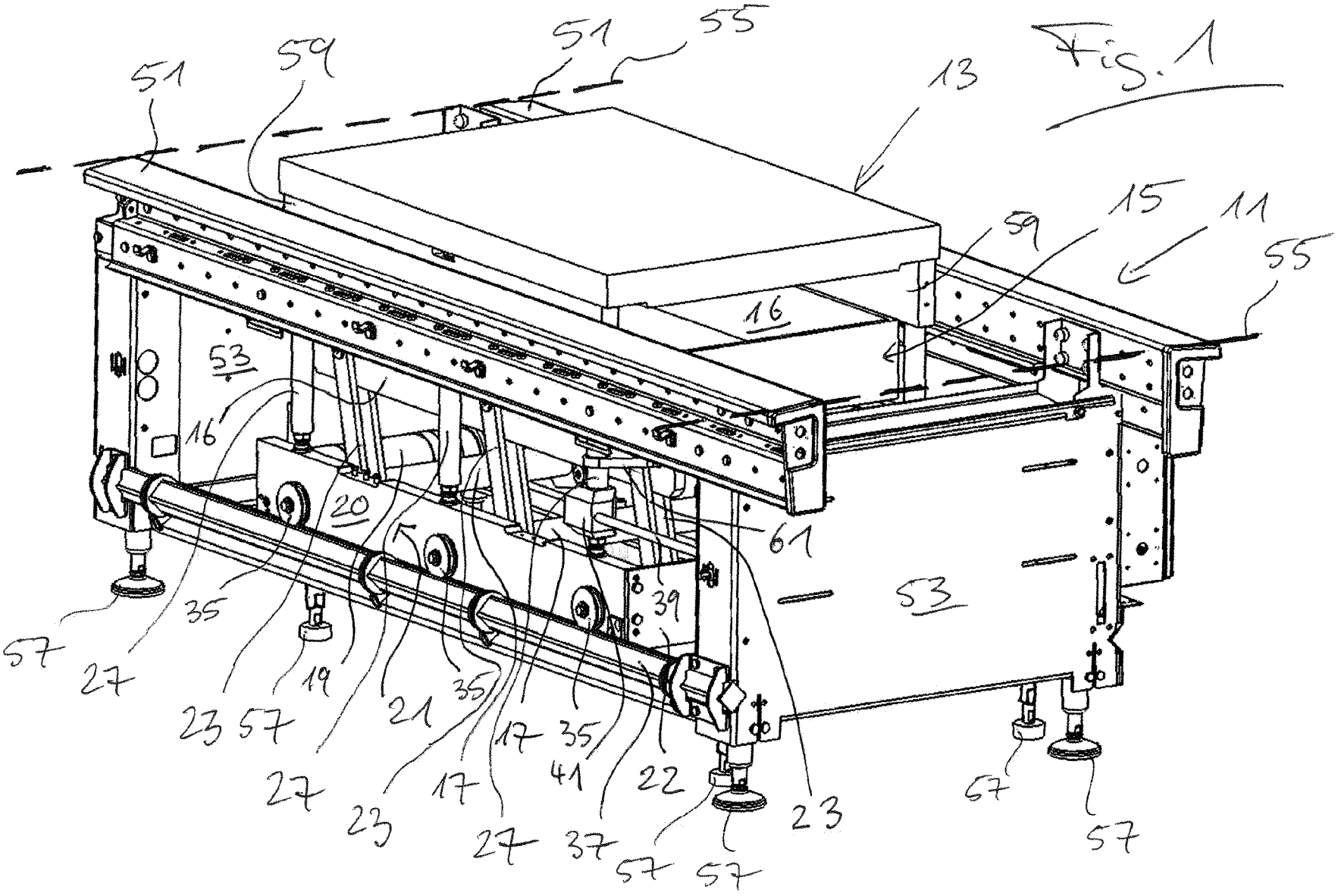

(51) Int. Cl.

| | |
|---|---|
| ***B65B 47/00*** | (2006.01) |
| ***B65B 51/10*** | (2006.01) |
| ***B65B 61/06*** | (2006.01) |

(56) References Cited

U.S. PATENT DOCUMENTS

| | | | | |
|---|---|---|---|---|
| 5,517,805 | A | 5/1996 | Epstein | |
| 2006/0236656 | A1* | 10/2006 | Bausch | B65B 59/04 53/167 |
| 2010/0011718 | A1 | 1/2010 | Donges et al. | |
| 2011/0247303 | A1* | 10/2011 | Haring | B65B 65/00 53/396 |

FOREIGN PATENT DOCUMENTS

| | | | | |
|---|---|---|---|---|
| DE | 102004006118 | A1 | 8/2005 | |
| DE | 102006050415 | A1 | 4/2008 | |
| DE | 102008019626 | A1 | 10/2009 | |
| DE | 102010054976 | A1 | 12/2011 | |
| DE | 102015211622 | A1 | 12/2016 | |
| DE | 10351567 | B4 | 6/2017 | |
| DE | 202015009453 | U1 | 10/2017 | |
| EP | 0847920 | A1 | 12/1997 | |
| EP | 1118540 | A1 | 12/2000 | |
| EP | 2666727 | A1 | 5/2012 | |
| EP | 2218575 | B1 | 1/2013 | |
| EP | 2666727 | A1 | 11/2013 | |
| WO | WO-2004110871 | A1 * | 12/2004 | B65B 65/02 |
| WO | 2008/046616 | A1 | 4/2008 | |
| WO | WO-2010095438 | A1 * | 8/2010 | B29C 66/8221 |

OTHER PUBLICATIONS

Official Communication from German Patent and Trademark Office for related Application No. DE 102017123805.0; dated May 16, 2018; 2 pages.

Official Communication from European Patent and Trademark Office for related International Application No. PCT/EP2018/077071; dated Oct. 5, 2018; 5 pages.

European Search Report dated Apr. 22, 2022 for European Application No. 21216572.4, 8 pages.

* cited by examiner 11
13
15
16
17
19
20
21
22
23
27
35
37
39
41
51
53
55
57
59
61

13
15
16
17
19
20
22
23
25
27
35
43
45
59
61

13
15
16
17
18
19
20
22
23
25
27
31
33
43
59
63
65
67
71
73
81

WORKING STATION WITH A LIFTING MECHANISM FOR A PACKAGING MACHINE

CROSS-REFERENCES TO RELATED APPLICATIONS

This application is a 371 National Phase Application of Patent Application PCT/EP2018/077071, filed on Oct. 5, 2018, which claims the priority of German Patent Application 102017123805.0, filed on Oct. 12, 2017, each of which is incorporated herein by reference, in their entirety.

The invention relates to a working station, in particular to a deep-drawing station, to a molding station, to a sealing station, to a cutting station or to a punching station, for a packaging machine, comprising a rack supported on the ground; a work unit comprising an upper part and a lower part; and a lifting mechanism which is carried by the rack and by which the lower part of the work unit can be raised and lowered relative to the rack to perform a lower stroke, wherein the lifting mechanism has a drive that comprises at least one shaft extending in a transverse direction; a drive motor engaging at the shaft for rotating the shaft; and at least one gear which is coupled at an input side to the shaft, at which the lower part is supported at an output side, and which converts a rotation of the shaft into the lower stroke of the lower part.

Such working stations are generally known and are in particular used at such packaging machines at which the packages are manufactured from film webs. In this respect, recesses are first produced in a lower film in a deep-drawing or shaping process; articles to be packaged such as food products are subsequently placed into the recesses; the recesses are then closed by sealing by an upper film; and the individual packages are thereupon separated by cutting out or punching out.

It is necessary at at least at some working stations of the packaging machine to raise and lower the tools used for the respective work process. A deep-drawing station, for example, has a working chamber which is formed by an upper chamber part and a lower chamber part, through which the film web can be conveyed in the open state, and in which the mentioned recesses are produced in the closed state in that the film web is acted on by a negative pressure from the lower chamber and by compressed air via the upper chamber. The two chamber parts have to be pressed together to close the chamber. In addition, high additional forces act on the chamber parts during the deep-drawing process due to the application of pressure onto a relatively large surface. Consequently, the lifting mechanism provided for opening and closing the chamber, the rack supporting the lifting mechanism, and the devices for supporting the lifting mechanism at the rack are subjected to considerable loads in practice that can correspond to a weight of a plurality of metric tons.

Consequently, known working stations for packaging machines are correspondingly of solid design and are provided with correspondingly powerful motor drives of a large design and with lifting mechanisms for performing the lifting movement. Such working stations are therefore large, heavy, and expensive. Furthermore, these working stations are in part only specially designed for an associated tool format or package format so that a continuous maintenance effort results depending on the design and the components used.

In addition, it is necessary in practice at some working stations not only to raise and lower the lower part of the respective work unit, but to perform a so-called upper stroke in addition to this lower stroke, i.e. also to raise and lower the upper part of the work unit. It should, for example, be ensured at a deep-drawing station that heating devices integrated in the upper chamber for heating the film web do not act on the film web too early before the actual deep-drawing process, but that the effect of heat only begins when the chamber is closed or on the start of the closing process. The upper stroke function leads to an even more complex design of the known working stations. Additional drives are in particular used for this purpose. However, even without an upper stroke functionality, some well-known working stations already have a large number of movable elements for performing the lower stroke as well as a plurality of drives that have to be synchronized in a complex manner.

Known working stations for packaging machines are, for example, described in EP 1 118 540 B1, DE 103 51 567 B4, DE 10 2004 006 118 A1, DE 10 2008 019 626 A1, DE 10 2015 211 622 A1, and EP 2 666 727 B1.

It is the object of the invention to provide a working station of the initially named kind which, in a simple and space-saving design, has a powerful lifting mechanism that can be loaded to a large extent.

This object is satisfied by the independent claims in each case.

In accordance with an independent aspect of the invention, provision is made that the shaft of the lifting mechanism is supported at the rack and carries a base at which the upper part is supported.

This concept makes it possible in an advantageous manner to absorb the forces within the lifting mechanism that occur during the working process, for example on the closing of the chamber of a deep-drawing station, without influencing the rack. The support of the lifting mechanism at the rack consequently only needs to introduce the weight of the lifting mechanism into the rack, but not the process forces acting within the lifting mechanism on the performance of the lower stroke and when the lower part is raised, that is—in a deep-drawing station—when the working chamber is closed, With respect to a possible practical embodiment, this, for example, means that the support of the lifting mechanism at the rack only has to be designed for a weight of some 100 kg, whereas process forces are active within the lifting mechanism that correspond to a weight of more than 10 t.

In accordance with the invention, the lifting mechanism consequently forms a unit that is mechanically independent and closed in itself both in a functional regard and with respect to the process forces active during operation and that only has to be carried by the rack of the working station.

Advantageous embodiments that can also be provided in connection with the further independent aspects of the invention explained elsewhere are indicated in the following and also result from the claims and the Figures as well as from the associated description of the Figures. This also applies in each case to the further independent aspects of the invention.

The base, which is carried by the shaft supported at the rack, can comprise a frame. Such a frame, for example a rectangular box structure having two longitudinal supports and two transverse supports, can provide a particularly high stability of the lifting mechanism. The interior of this stability frame is in particular available for movable parts of the lifting mechanism.

The gear provided between the shaft and the lower part is preferably configured as a coupling gear, in particular as a slider crank gear. It is preferably a central slider crank gear.

The gear between the shaft and the lower part can comprise a toggle lever arrangement. The toggle lever arrangement is in particular stretched in a position with the lower part raised to the maximum, said position in particular corresponding to a closed work unit. It can hereby be ensured that no torque is exerted onto the shaft by the lower part on a maximum load by the process forces. This position of the gear is also designated as a stretched position or a neutral position in the following.

The gear between the shaft and the lower part can comprise at least one pair of congruent and mutually spaced apart connecting rods between which a shaft crank rotationally fixedly connected to the shaft is connected in an articulated manner at the input side and the lower part or a support for the lower part is connected in an articulated manner at the output side.

Due to such a symmetrical design, the creation of disturbing tilt torques are prevented. Measures for absorbing, storing or leading off corresponding transverse forces can thus be omitted.

The shaft is preferably rotatably supported in longitudinal supports of the base that are spaced apart from one another in the transverse direction. The shaft can hereby carry the base in a particularly simple constructional manner and can also increase the stability of the base due to the transverse connection between the longitudinal supports formed by the shaft.

The gear preferably comprises at least two individual gears that are spaced apart along the shaft and that are synchronized by means of the shaft for a joint performance of the lower stroke. Consequently, a shaft can engage at a plurality of points spaced apart in the transverse direction, in each case via a gear at the lower part. This further increases the stability and provides a distribution of the process forces active in operation.

The lifting mechanism preferably comprises a plurality of shafts that are spaced apart along the rack, that are synchronized and that each have a gear for the joint performance of the lower stroke. A plurality of shafts in turn increase the stability of the lifting mechanism since an engagement at the lower part at points spaced apart in the longitudinal direction is possible. The number of shafts can generally be selected as desired in particular in order to adapt the lifting mechanism to the respective required installation length of the working station.

A plurality of shafts are in particular of advantage in combination with the embodiment explained above, according to which the respective gear is divided at each shaft into at least two individual gears spaced apart along the shaft.

Two synchronized individual gears are preferably provided per shaft that are arranged in the region of the outer sides of the lifting mechanism, i.e. a left individual gear—e.g. viewed in the conveying direction of a film web running through the working station—and a right individual gear of a respective shaft engage at the lower part. The space between the two individual gears can then be used for other purposes.

A particularly precise movement routine of the lower part relative to the upper part can in particular be achieved in that, in accordance with a further embodiment, during the lower stroke, the lower part is guided at the base, at the upper part, or at a column supporting the upper part at the base. To further increase the stability of the lifting mechanism, provision can in this respect be made that the column stands directly above the shaft, i.e. the column is supported at the base such that a vertical central axis of the column intersects the axis of rotation of the shaft.

In accordance with a preferred design of the gear explained above, a left column and a right column can be provided for a respective shaft so that the upper part in the region of this shaft is supported at two points at the base that are spaced apart in the transverse direction and is thus supported at the shaft carrying the base.

The arrangement of columns directly above the shafts advantageously ensures a direct leading off of the weight of the upper part into the shaft and thus into the rack.

The upper part can be vertically adjustably supported at the base. The position of the upper part can hereby, for example, be set relative to a film plane, i.e. to the plane that is defined by a film web running through the working station and that is thus determined externally, i.e. not by the working station, but by the packaging machine in which the working station is integrated.

A plurality of columns supporting the upper part at the base can simultaneously serve to set the position of the upper part if, in accordance with a further embodiment of the invention, the columns or their supports are vertically adjustable at the base.

In accordance with a further embodiment, the drive motor engages at the shaft via a coupling gear. This coupling gear is not to be understood as the motor gear having the drive shaft of the motor as the input member, but as a coupling gear that comprises an output member, for example a motor crank, that can be set into rotation by means of the drive motor and that cooperates with the shaft via the coupling gear.

Provision is made in a preferred embodiment of the invention that, in a position with the lower part lowered to the maximum, said position in particular corresponding to an open work unit, the torque applied to a drive shaft of the drive motor via the coupling gear is zero or approximately zero. The drive motor hereby does not need to apply a holding torque when the lower part is lowered to the maximum so that the drive motor can, for example, be replaced without problem in this situation.

In a preferred embodiment, the coupling gear is configured as a four-bar linkage that comprises a drive shaft of the drive motor; a motor crank connected to the drive shaft; a drive coupling connected in an articulated manner to the motor crank; and a shaft crank rotationally fixedly connected to the shaft and connected in an articulated manner to the drive coupling. A motor gear which will not be looked at in any more detail at this point is in particular provided between the drive shaft of the motor and the motor crank.

The arrangement of such a four-bar linkage between the drive motor and the shaft in particular enables an advantageous cooperation with the gear between the shaft and the lower part if the two gears are correspondingly coordinated with one another. This will be looked at in more detail at another point.

Provision is made in a preferred embodiment of the invention that, in a position with the lower part lowered to the maximum, said position in particular corresponding to an open work unit, the axis of rotation of the drive shaft of the drive motor, the articulated axis between the motor crank and the drive coupling and the articulated axis between the drive coupling and the shaft crank lie at least approximately in one plane. This position of the coupling gear is also designated as the stretched position or the neutral position in the following. An advantage of this position is that no torque acting in the sense of a further lowering of the lower part can be applied to the drive shaft of the motor via the shaft, which means the possibility of a simple exchangeability of the motor already mentioned above.

The drive motor is preferably an electric motor, in particular a servo motor. Alternatively, a pneumatic or hydraulic drive can also be provided.

In accordance with a further embodiment of the invention, the base can be lowered and raised relative to the rack to perform an upper stroke of the upper part. The lifting mechanism can hereby be provided with an integrated upper stroke function. Possible designs of the lifting mechanism for implementing this upper stroke function will be looked at in more detail at another point.

The lower stroke and the upper stroke are preferably positively coupled to one another. The lower stroke movement and the upper stroke movement can hereby support one another in an advantageous manner. This positive coupling preferably takes place by the shaft.

Provision is preferably made that the upper stroke and the lower stroke extend in opposite senses to one another.

Furthermore, provision is made in accordance with an embodiment of the invention that the lifting mechanism is adjustable relative to the rack in a longitudinal direction. The working station can hereby be adapted in a conceivably simple manner to different applications in the operation of the packaging machine, in particular to different format sets, i.e. to arrangements of a predefined number of packages relative to one another, or to the cycle of the packaging machine.

An adjustability of the lifting mechanism as a whole relative to the rack in particular results from the fact that the lifting mechanism represents a unit that is closed in itself and that is only supported at the rack via one or more shafts. It is hereby possible in accordance with a preferred embodiment of the invention to configure the lifting mechanism in the manner of a slide or a carriage that can be displaced or moved as a whole on the rack in order to be brought into the respective desired position within the working station and consequently within the respective packaging machine.

Provision can in particular be made that the lifting mechanism is supported at the rack via a plurality of support members, in particular rollers or shafts, and is adjustable, in particular movable, relative to the rack in the longitudinal direction by means of the support members.

The rack can have at least two support sections which extend spaced apart in parallel in the longitudinal direction, at which the lifting mechanism is supported, and along which the lifting mechanism is adjustable relative to the rack.

The lifting mechanism and the rack can in particular cooperate as a wheel/rail system with respect to the adjustability in the longitudinal direction. For lateral guidance of the lifting mechanism at the rack, the support members which are preferably configured as rollers can each be provided with a recess or a step.

In accordance with a further embodiment, a fixing device can be provided by means of which the position of the lifting mechanism in the longitudinal direction can be fixed at the rack. The fixing device can comprise a spindle drive for setting the longitudinal position of the lifting mechanism. The spindle drive can comprise a spindle attached to the rack; and a spindle nut, with the spindle nut preventing a movement of the lifting mechanism relative to the rack in the longitudinal direction and allowing said movement in a lift direction.

The spindle nut can, for example, be longitudinally displaceably connected to a column supporting the upper part at the base in order to enable an upper stroke movement of the upper part in this manner.

In accordance with a further independent aspect of the invention, the lifting mechanism comprises a plurality of shafts that are spaced apart along the rack, that are synchronized and that each have a gear for the joint performance of the lower stroke.

By providing a plurality of shafts, the lifting mechanism can engage at the lower part at points spaced apart in the longitudinal direction. This increases the stability and provides a precise alignment of the lower part relative to the upper part.

Exactly one drive motor is preferably provided for a synchronous rotation of the shafts. This simplifies the design of the lifting mechanism and reduces the costs.

The drive motor is preferably arranged outside each pair of shafts in the longitudinal direction. This has the advantage that the drive motor is not in the way of the movable parts of the lifting mechanism. The space between the shafts can consequently be used for other purposes.

The drive motor or an axis of rotation of a drive shaft of the drive motor preferably lies at least approximately in a plane defined by the axes of rotation of the shafts. Construction space above or below this plane defined by the shafts is consequently not required for the drive motor.

Provision is made in accordance with a further embodiment that the shafts are supported at the rack and together carry a base which preferably comprises a frame and at which the upper part is supported, wherein the drive motor is arranged outside the base. Due to the arrangement of the drive motor outside the base, the interior of the base is available for other purposes, for example, for electrotechnical, pneumatic or hydraulic lines in connection with the function of the tool used in the working station. The drive motor itself in particular does need to be taken into account in the design of the movable parts of the lifting mechanism and their kinematics.

The drive motor is preferably supported at a transverse support of the base.

Provision is furthermore preferably made that the drive motor is arranged such that a drive shaft of the drive motor extends in parallel with the shafts. This facilitates the coupling between the drive motor and the shaft. An angular gear for the drive motor can in particular be dispensed with.

The shafts are preferably mechanically synchronized.

The shafts are preferably rotatable in the same sense. This enables a particularly simple design and a space-saving arrangement of the movable parts for synchronous rotation of the shafts.

In accordance with an embodiment of the invention, the shafts are connected to one another by at least one synchronization coupling. Provision is in particular made in this respect that the drive motor engages at one of the shafts via a coupling gear and at the or each other shaft via the synchronization coupling coupled to the coupling gear. If more than two shafts are provided, either a single synchronization coupling connecting all the shafts to one another can be provided. Alternatively, a plurality of synchronization couplings connected behind one another can be provided. This has the advantage that the synchronization couplings can engage at the shafts at different transverse positions. The design of the lifting mechanism can hereby be more flexible.

Provision is made in accordance with a further embodiment that the synchronization coupling engages at the shafts via a respective shaft crank rotationally fixedly connected to the shaft.

Provision is made in accordance with a further independent aspect of the invention that the drive motor engages at the shaft via a gear.

As already mentioned above, by providing a gear between the drive motor and the shaft, this gear can be coordinated with the gear between the shaft and the lower part with respect to the respective conditions. This not only relates to the situations explained in more detail in the following when the lower part is raised to the maximum and when the lower part is lowered to the maximum, but rather also to the movement routine and to the development of the forces or torques during the performance of the lifting movement between the two mentioned extreme positions.

The design of the gears and the arrangement of the movable parts within the lifting mechanism and thus within the working station, on the one hand, and the torque development, on the other hand, can in particular be coordinated with one another such that a relatively small drive motor having a comparatively low power is sufficient to perform the respective required lifting movement and the movable parts of the lifting mechanism require little space.

Reference is made to the above statements with respect to possible embodiments of the gear provided between the drive motor and the shaft.

Provision is made in a preferred embodiment that the gear between the lower part and the shaft and the gear between the drive motor and the shaft are configured and coordinated with one another such that a respective one of the gears adopts a neutral position when the lower part is raised to the maximum and when the lower part is lowered to the maximum.

The torque applied by the lower part to the shaft is in particular zero or approximately zero when the lower part is raised to the maximum. This can, for example, be achieved by a toggle lever arrangement of the gear between the shaft and the lower part, said toggle lever arrangement being stretched in this position.

Provision can furthermore in particular be made that the torque applied by the lower part to a drive shaft of the drive motor is zero or approximately zero when the lower part is lowered to the maximum. As already mentioned elsewhere, this can, for example, be achieved by a stretched configuration of a four-bar linkage forming the gear between the drive motor and the shaft.

A shaft crank rotationally fixedly connected to the shaft can be provided as a common element, and in particular as the only common element, of the two gears.

A preferred embodiment furthermore provides that, when the maximum stroke distance of the lower part is performed, a motor crank connected to the drive motor rotates by a larger angle than the shaft. The angle of rotation of the motor crank can in particular be greater than the angle of rotation of the motor shaft by approximately 20 to 70%, in particular by approximately 40 to 60%.

In a practical embodiment, the maximum stroke distance of the lower part corresponds to a rotation of the shaft by approximately 80° to 120°, in particular by approximately 100°.

Provision can furthermore be made that the maximum stroke distance of the lower part corresponds to a rotation of a motor crank connected to the drive motor by approximately 140° to 160°, in particular by approximately 150°.

In accordance with a further independent aspect of the invention, provision is made that the upper part can be lowered and raised relative to the rack to perform an upper stroke.

As already initially mentioned, it is necessary for some applications that not only the lower part of the work unit can perform a lower stroke, but also that the upper part can be lowered and raised relative to the rack.

A particularly advantageous possibility of performing an upper stroke results in a design of the lifting mechanism and in a manner of the support of the lifting mechanism at the rack as was explained above in connection with one of the other independent aspects of the invention. The possibility of performing an upper stroke is not mandatory in such a concept, but can be implemented in a simple manner to integrate an upper stroke function in the lifting mechanism.

Accordingly, the upper part is preferably supported at the rack via the lifting mechanism. The upper part is in particular supported at the rack via the shaft.

A preferred manner of integrating an upper stroke function in the lifting mechanism provides that the shaft is eccentrically supported at the rack with respect to its axis of rotation. A rotation of the shaft about its axis of rotation consequently has the result of a movement of the axis of rotation relative to the rack with a vertical component. This movement of the shaft can be used to perform an upper stroke movement of the upper part.

Consequently, in accordance with the invention, a lifting mechanism with a centrally supported shaft and without an upper stroke function can be converted in a simple manner into a lifting mechanism with an upper stroke function by changing the central support of the shaft into an eccentric support. In addition, the relationship between the angle of rotation of the shaft and the stroke distance of the upper stroke movement resulting therefrom can be changed by changing the eccentricity of the eccentric support of the shaft.

The upper part is preferably supported at a base of the lifting mechanism, said base preferably comprising a frame, wherein the shaft is rotatably supported in the base.

If the shaft is eccentrically supported and rotated with respect to its axis of rotation, the resulting vertical movement of the shaft is transmitted to the base and thus to the upper part.

At least two support members spaced apart along the shaft can be provided for supporting the shaft at the rack, at which support members the shaft is in each case eccentrically supported with respect to its longitudinal axis. When the shaft rotates, the shaft consequently moves relative to the support members in the vertical direction in order to perform the upper stroke function in this manner.

So that the shaft can be fixed relative to the rack during its rotation in the longitudinal direction, provision can be made in accordance with a further preferred embodiment that the support members are capable of an evasion movement in the longitudinal direction. In this manner, the horizontal component resulting on the rotation of the eccentrically supported shaft can be received.

The support members preferably each comprise a roller or a roll.

Whereas a rotation of the shaft not only brings about the raising and lowering of the lower part in this manner, but simultaneously results in a vertical movement of the shaft, which can be converted into an upward or downward movement of the upper part, this means that the lower stroke of the lower part and the upper stroke of the upper part are positively coupled to one another via a rotation of the shaft.

Provision is preferably made that the lower stroke and the upper stroke extend in opposite senses to one another. The two stoke movements can consequently support one another, whereby the maximum power to be applied by the drive motor can be considerably reduced.

In a possible practical embodiment, the effective working stroke of the work unit provided by the difference between the lower stroke and the upper stroke amounts to approximately 75 to 85 mm, preferably to approximately 80 mm.

The maximum amount of the upper stroke preferably amounts to approximately 0.2 times to 0.3 times the maximum amount of the lower stroke.

The maximum amount of the upper stroke preferably amounts to approximately 20 to 30 mm, preferably to approximately 25 mm.

Provision can in particular be made that the maximum amount of the lower stroke amounts to approximately 95 to 115 mm, preferably to approximately 105 mm.

These embodiments can be respectively provided in combination with the above-mentioned practical embodiments relating to the possible angles of rotation of the shaft (in particular approximately 100°) and of the motor crank (in particular approximately 150°) for the maximum stroke distance of the lower part, i.e. for the maximum lower stroke.

The invention relates to a packaging machine comprising at least one working station in accordance with the invention.

The invention will be described in the following by way of example with reference to the drawing. There are shown:

FIG. 1 a perspective view of a working station comprising a lifting mechanism in accordance with a first embodiment of the invention;

FIGS. 2 and 3 different side views of the lifting mechanism in accordance with the invention of FIG. 1; and FIGS. 4 to 6 different views of a lifting mechanism in accordance with a second embodiment of the invention.

The working station shown in FIG. 1 is a deep-drawing station of a packaging machine, which comprises a rack 11 standing on the ground and having two upper support sections 51 and two lower support sections 37 that extend in a conveying direction, also designated as a longitudinal direction in the following, in which a film web, not shown, is conveyed in a generally known manner through the packaging machine and thus through the deep-drawing station shown in FIG. 1. Chain guides (not shown) are inwardly attached to the support sections 51 to guide conveyor chains that are likewise not shown and that laterally hold the passing-though film web in a generally known manner.

The film plane 55, which is indicated by dotted lines in FIG. 1 and in which the film conveying device, not shown, and the film web are disposed during operation, represents the reference plane for the tool of the deep-drawing station shown. In practice, this reference plane is typically disposed somewhat below the upper margin of the support sections 51. The tool is a working chamber, also designated as a deep-drawing chamber, that comprises a lower part 15 and an upper part 13. The height of this reference plane above the ground, on which the rack 11 of the deep-drawing station and the packaging machine stand, is predefined by the packaging machine so that the movements of the lower part 15 and of the upper part 13 of the working chamber of the deep-drawing station have to be coordinated with the position of the film plane 55.

The lower part 15 and the upper part 13 are carried by a lifting mechanism, explained in more detail below, that is inserted as an independent functional unit into the working station between the two lower support sections 37 and the two upper support sections 51. The lifting mechanism is supported as a whole by the rack 11 and is for this purpose solely supported by means of support members, in the form of rollers 35, at the support sections 37.

The two upper support sections 51 and the two lower support sections 37, at which the lifting mechanism is supported via the rollers 35, are fastened to the outer sides of two plate-like transverse members 53 that are spaced apart in the longitudinal direction and that are supported on the ground by feet 57. The lifting mechanism is consequently located within a frame formed by the rack 11 as a support structure that comprises the two transverse members 53; the two upper support sections 51; and the two lower support sections 37.

The lifting mechanism explained with respect to its basic design with reference to FIG. 1 in the following is subsequently described in more detail in connection with FIGS. 2 to 6.

The basic design of the lifting mechanism comprises, at the bottom, a box-shaped frame composed of two lateral longitudinal supports 20 that extend in the longitudinal direction and that are connected to one another by two transverse supports 22. This frame forms a stable base of the lifting mechanism.

A plurality of—in the embodiment of FIG. 1, three—shafts 17 are rotatably supported in the region of their ends in the longitudinal supports 20 of the frame. The already mentioned support rollers 35 are connected to the end faces of the shafts 17, that is they are not directly connected to the longitudinal supports 20 of the frame.

The support of the lifting mechanism at the rack 11 is consequently characterized in that the shafts 17 are supported via the rollers 35 at the support sections 37 of the rack 11, on the one hand, and in that the shafts 17 carry the longitudinal supports 20 and thus the rack and consequently the total lifting mechanism, on the other hand.

The frame comprising the longitudinal supports 20 and the transverse supports 22 forms a base of the lifting mechanism at which the upper part 13 of the working chamber is directly supported. For this purpose, columns 27 are provided that are each supported vertically above one of the shafts 17 on the longitudinal supports 20 and that support a respective longitudinal member 59 of the upper part 13.

A manually actuable height adjustment is provided between the lower end of each column 27 and the respective longitudinal support 20 of the frame and enables a setting of the spacing between the upper part 13 and the frame such that the position of the upper part 13 can be exactly set with respect to the position of the lower part 15 in the closed state and the film thickness is in particular taken into account in this respect.

Due to the support of the lifting mechanism at the rack 11 via the rollers 35, the lifting mechanism is a carriage that can be moved relative to the rack 11 in the longitudinal direction on the setting up of the packaging machine. The lifting mechanism is not completely freely movable in this respect, but is rather coupled to the rack 11 via a fixing device in the form of a spindle drive comprising a spindle 39 and a spindle nut 41. The spindle 39 extends in the longitudinal direction and is attached to the rack 11 such that it can be rotated about its longitudinal axis by manual actuation. By rotating the spindle 39, the spindle nut 41 connected to the column 27 is acted on in the longitudinal direction and the lifting mechanism is thereby moved in the longitudinal direction. The longitudinal position of the lifting mechanism in the rack 11 can consequently be changed and adapted to a respective application, with the longitudinal position of the lifting mechanism, however, being fixed by the fixing device formed by the spindle drive 39, 41 during the deep-drawing operation.

To perform an upper stroke, which is explained in more detail in the following, the lifting mechanism can be raised and lowered as a whole. This means that the frame 20, 22 together with the upper part 13 supported via the columns 27 and with the lower part 17 carried by the shafts 17 can be raised and lowered relative to the rack 11. To make this upper stroke possible, the spindle nut 41 is longitudinally displaceably supported at the respective column 27.

The lower part 15 is supported at the shafts 17 via a respective gear described in more detail in the following of which a respective pair of congruent and mutually spaced apart connecting rods 23 is shown in FIG. 1 between which a support 16 of the lower part 15 is connected in an articulated manner.

The shafts 17 are connected to one another by a common synchronization coupling 43, not shown in FIG. 1, and are thereby mechanically synchronized. The actuation of the synchronization coupling 43 for a synchronous rotation of the shafts 17 takes place by a drive motor 19 arranged outside the frame 20, 22 at the level of the shafts 17. The motor 19 is supported at the transverse support 22 of the frame at the rear in FIG. 1 and is installed transversely to the extent that the drive shaft, not shown in FIG. 1, of the motor 19 extends in parallel with the shafts 17.

A respective outwardly projecting lug 61 is fastened to the outer sides of the two supports 16 of the lower part 15 and is guided along one of the columns 27 supporting the upper part 13 at the longitudinal support 20 of the frame. The lower part 15 is hereby guided at the upper part 13 when a lower stroke is performed. In this way, the lower part 15 and the upper part 13 are precisely aligned relative to one another.

FIGS. 2 to 6 show a first embodiment (FIGS. 2 and 3) and a second embodiment (FIGS. 4, 5 and 6) of a lifting mechanism in accordance with the invention. The lifting mechanism in accordance with FIGS. 2 and 3 corresponds to the lifting mechanism of the working station shown in FIG. 1. The lifting mechanism in accordance with FIGS. 4, 5 and 6 is generally designed like the lifting mechanism in accordance with FIGS. 2 and 3, but has a smaller working length provided for smaller tools and is for this purpose provided with only two shafts 17, whereas the lifting mechanism in accordance with FIGS. 2 and 3 has three shafts 17 arranged behind one another in the longitudinal direction.

In some representations, some components are not shown in order to illustrate special features of the design. For example, in FIG. 2*a*, the roller 35 at the left gear and the connecting rod 23 at the front in this side view are not shown. In FIG. 2*b*, for example, the rollers 35 and the front connecting rods 23 are not shown for any one of the three gears. The motor shaft 29 can, in contrast, be recognized in FIG. 2*b*. This applies correspondingly to FIGS. 3*a* and 3*b*. In addition, FIGS. 2*a* and 3*a* each show a front support section 37, whereas a rear support section 37 of the rack is shown in FIGS. 2*b* and 3*b*. In FIGS. 4, 5 and 6, the lifting mechanism is shown without components belonging to the rack in each case.

Due to the generally identical design, the following explanations relating to the embodiment of FIGS. 2 and 3 also apply to the embodiment of FIGS. 4, 5 and 6.

Figure 2A:
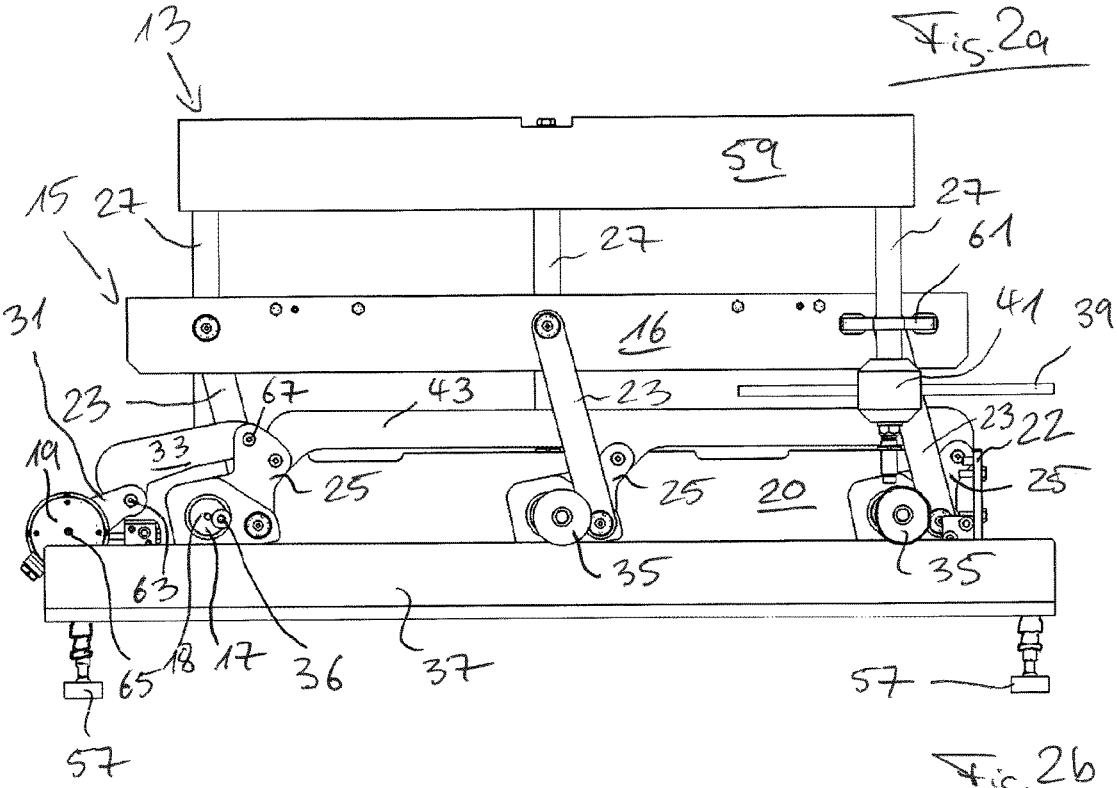
Figure 2B:
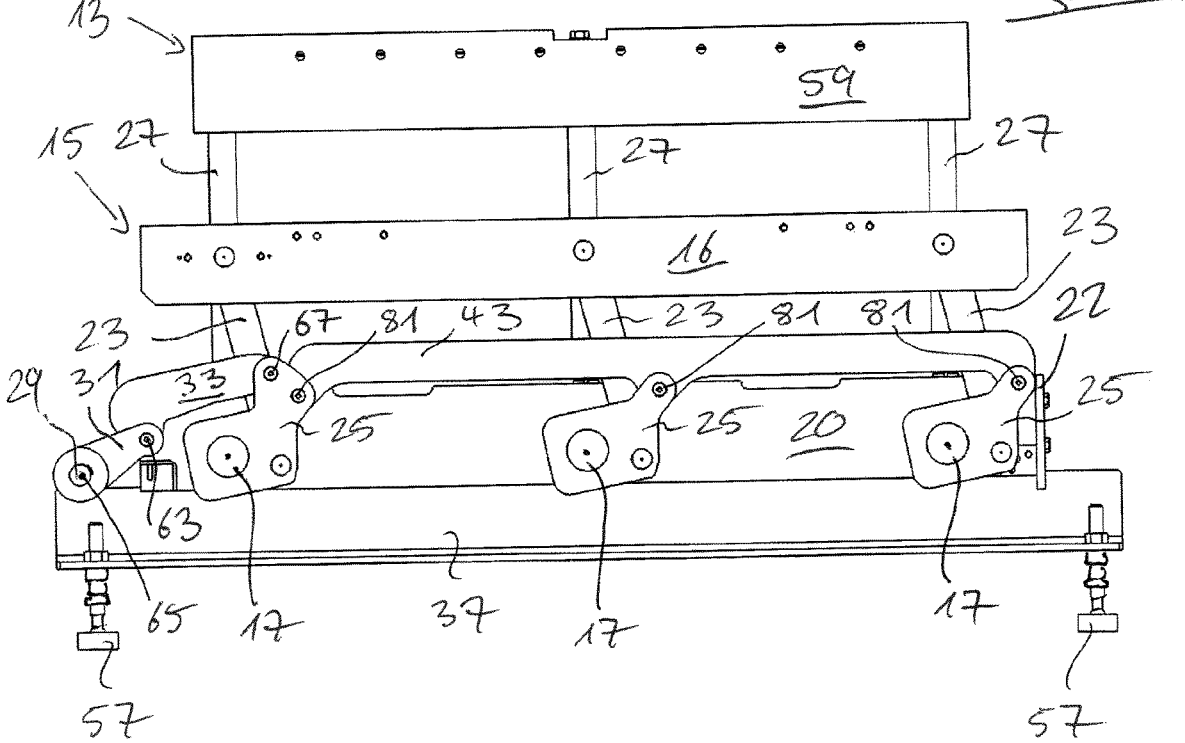
Figure 3A:
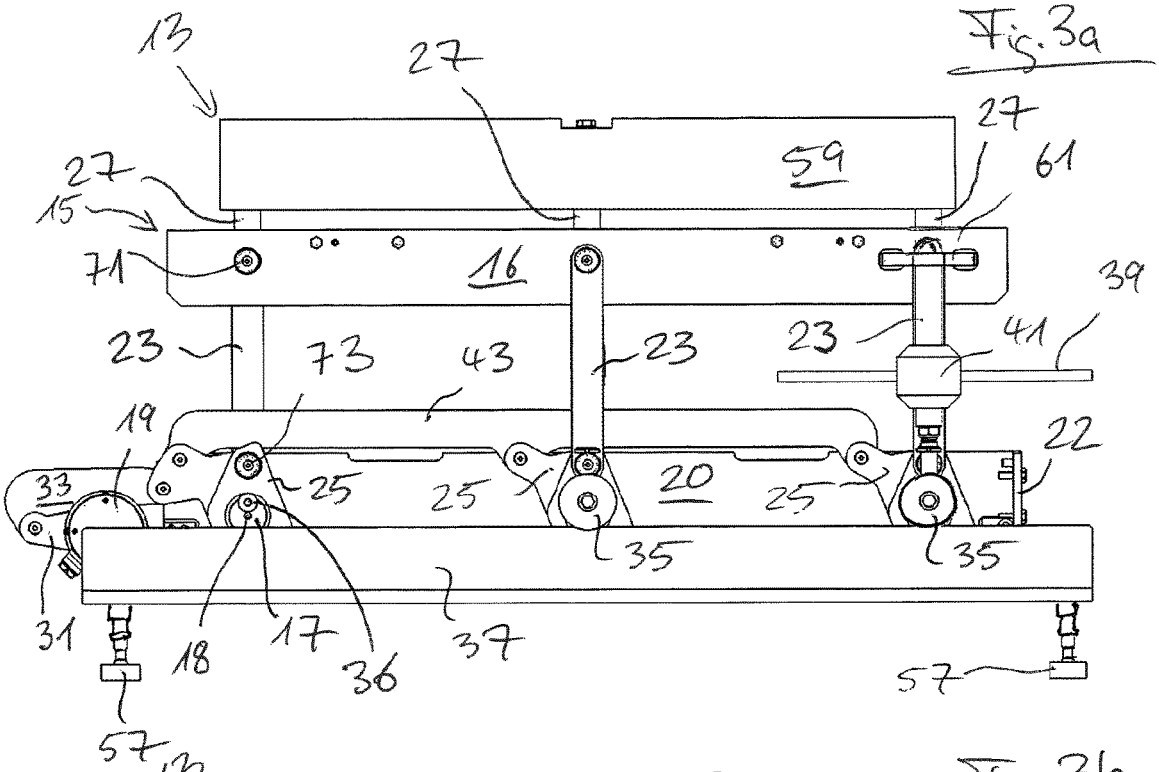
Figure 3B:
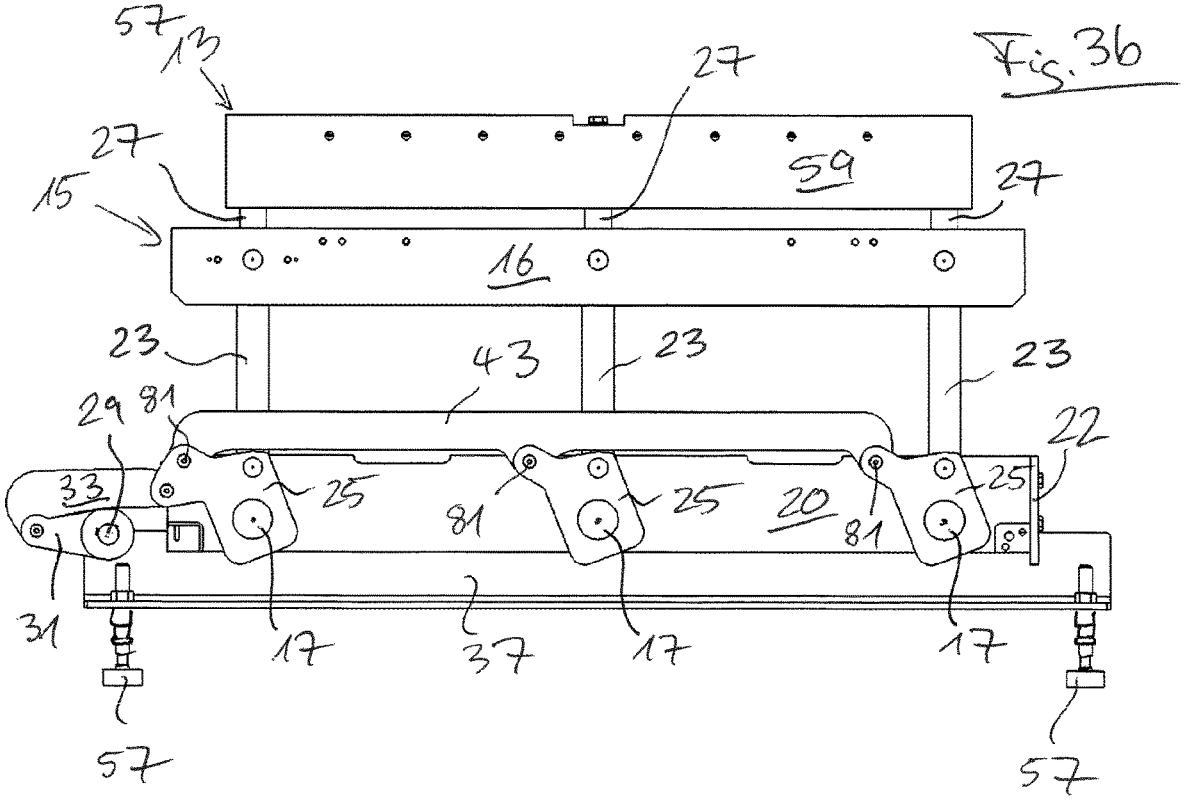

In FIGS. 2*a* and 2*b*, the respective lower part 15 of which a longitudinal support 16 is shown is open in the position lowered to the maximum, i.e. the working chamber comprising the lower part 15 and the upper part 13 is open. In contrast, FIGS. 3*a* and 3*b* show the state of the working station when the working chamber is closed and in which the lower part 15 is in the position raised to the maximum.

The lifting mechanism is here moreover provided with an upper stroke function for the upper part 13: When the chamber is open in accordance with FIGS. 2*a* and 2*b*, the upper part 13 is in the position raised to the maximum, whereas the position of the upper part 13 lowered to the maximum when the working chamber is closed is shown in FIGS. 3*a* and 3*b*.

The lower stroke movement of the lower part 15 and the upper stroke movement of the upper part 13 are positively coupled to one another via the shafts 17 and extend in opposite senses to one another, i.e. a raising of the lower part 15 is connected to a lowering of the upper part 13, and vice versa. The shafts 17 are synchronized with one another via a synchronization coupling 43 that engages at the shafts 17 via a respective shaft crank 25 rotationally fixedly connected to the respective shaft 17. The synchronization coupling 43 is in each case pivotally connected in an articulated manner to the shaft cranks 25 about an articulated axis 81.

The rotation of the shafts 17 which are synchronized with one another takes place by means of a single electric motor 19 that engages at the shaft 17 at the left in the Figures, and indeed via a motor crank 31 that is connected to a drive shaft 29 of the motor 19 and that is connected in an articulated manner via a drive coupling 33 to the shaft crank 25 of this shaft 17.

Starting from the open position in accordance with FIGS. 2*a* and 2*b*, the motor 19 rotates the motor crank 31 counterclockwise by approximately 150°, whereby all the shaft cranks 25 together with the shafts 17 likewise synchronously rotate counterclockwise, and indeed by an angle of rotation of approximately 100°. A reduction is consequently provided between the motor crank 31 and the shafts 17.

The rotation of the motor cranks 25 is converted into a movement of the two connecting rods 23 in each case, whereby the respective longitudinal support 16 of the lower part 15 is moved upwardly.

As already mentioned elsewhere, the design of the two individual gears at the left end and at the right end of each shaft 17 is identical, i.e. each shaft 17 engages at two points spaced apart in the transverse direction by a respective arrangement of the motor crank and the connecting rods 23 at the respective longitudinal support 16 of the lower part 15. The motor 19 is, in contrast, only connected to the shaft crank 25 at the rear in the side view selected here via the motor crank 31 and the drive coupling 33.

The design of the lifting mechanism selected in the two embodiments described here is advantageous in a plurality of aspects:

When the working chamber is closed in accordance with FIGS. 3*a* and 3*b*, the toggle lever arrangements, which are each formed by a shaft crank 25 and the associated connecting rods 23, are each in a vertically stretched position. In this neutral position of the gear, the lower part 15 consequently does not exert any torque on the shafts 17. The total effective weight is transferred directly via the shafts 17 and the support rollers 35 connected to the shafts 17 into the longitudinal supports 37 and thus into the rack of the working station.

In the open position of the working chamber in accordance with FIGS. 2*a* and 2*b*, the four-bar linkage formed by the drive shaft 29 of the motor 19, by the motor crank 31, by the drive coupling 33, and by the shaft crank 25 are likewise in a neutral position in the sense of a stretched state in which the relevant axes are disposed in a common plane. The relevant axes are the axis of rotation 65 of the drive shaft 29 of the motor 19, the articulated axis 63 between the motor crank 31 and the drive coupling 33, and the articulated axis 67 between the drive coupling 33 and the shaft crank 25. This stretched state has the result that the shaft crank 25 cannot rotate further clockwise and that the total effective weight of the lower part 15 and of the gear consequently cannot exert any torque on the drive shaft 29 of the motor 19. When the working chamber is open, i.e. when the lower part 15 is lowered to the maximum, the motor 19 is thus free of external forces. The motor 19 consequently does not need to be acted on by a holding current to generate a torque counteracting a weight. In particular when the working chamber is open, the motor 19 that is free of forces in this respect can be replaced without problem or separated from the motor crank 31 for other reasons.

The movable parts and their connections are moreover optimized and arranged relative to one another such that, when taking into account an upper stroke movement of the upper part 13 explained in more detail in the following, an ideal force development or torque development without disadvantageous force or torque peaks results over the total opening or closing movement of the working chamber, that is over the total angle of rotation of the motor crank 31 or of the shafts 17.

With respect to the shafts 17 and thus to a reference system only of the lifting mechanism, the above-described movement routine of the lower stroke of the lower part 15 is independent of the manner of the support of the lifting mechanism at the rack 11 (cf. FIG. 1) or at the support sections 37 of the rack. With regard to the rack 11 supported on the ground and thus to the film plane 55 that adopts a fixed height with respect to the rack 11, the maximum stroke distance of the lower part 15 relative to the shafts 17 (as mentioned in the introductory part, e.g. 105 mm), in contrast, does not correspond to the effective working stroke of the working chamber (e.g. 80 mm). The reason for this is that the rotation of the shafts 17 effected for the performance of the lower stroke of the lower part 15 simultaneously results in a lowering of the shafts 17. The lowering of the shafts 17 results in a downward movement of the total lifting mechanism, including the upper part 13 supported via the columns 27 at the shafts 17 relative to the rack and thus relative to the film plane 55. The upper stroke e.g. amounts to 25 mm so that the mentioned maximum effective working stroke of 105 mm−25 mm=80 mm results that is designed as sufficiently large for applications having a required effective working stroke of the working chamber of approximately 75 mm.

The lowering of the shafts 17 is achieved by an eccentric support of the shafts 17 at the support rollers 35. This concept can be reproduced particularly well by means of FIGS. 2*a* and 3*a* in which the support roller 35 is not shown at the left gear in each case. Instead, it can be recognized there that the axes of rotation 18 of the shafts 17 do not coincide with the axes of rotation of the support rollers 35 that are also designated as eccentric axes 36 in the following. The eccentricity, i.e. the radial spacing between the axis of rotation 18 of the shaft 17 and the eccentric axis 36 determines—at a given maximum angle of rotation of the shaft 17—the maximum stroke distance of the upper stroke.

When the working chamber is closed in accordance with FIG. 3*a*, that is in the respective stretched state of the toggle lever arrangement comprising the shaft crank 25 and the connecting rods 23, the eccentric axes 36 are each also disposed in the common vertical plane of the articulated axis 71, the articulated axis 73 and the shaft rotational axis 18. The eccentric axes 36 are in this respect each disposed vertically above the axis of rotation 18 of the respective shaft 17, i.e. the shafts 17 and thus the total lifting mechanism, in particular including the upper part 13, are lowered to the maximum with respect to the rack.

When the chamber is, in contrast, open in accordance with FIG. 2*a*, the shafts 17 and thus the upper part 13 are raised to the maximum with respect to the rack, wherein, starting from an angle of 0° when the chamber is closed in accordance with FIG. 3*a*, a common plane of the shaft axis of rotation 18 and the eccentric axis 36 includes the angle of approximately 100° to the vertical already mentioned above. This angle is the maximum angle of rotation of the shafts 17.

Since the total lifting mechanism is fixedly connected to the spindle 39 and thus to the rack in the longitudinal direction via the spindle nut 41 cooperating with the right column 27, the evasion movement in the longitudinal direction required due to the eccentric movements of the shafts 17 around the support rollers 35 is not performed by the lifting mechanism, but by the support rollers 35 that roll off the support sections 37 of the rack for this purpose. This can, for example, be understood particularly well in FIGS. 2*a* and 3*a* with reference to the positions of the rollers 35 in the longitudinal direction relative to the columns 27 that are in a fixed position in the longitudinal direction.

At the same time, the support rollers 35 enable a positioning of the lifting mechanism in the longitudinal direction by a manual rotation of the spindle 28, as had already been described above in the present case.

In this respect, the lifting mechanism is a carriage that is movable in the longitudinal direction on the support sections 37 of the rack, that has wheels, formed by the support rollers 35 arranged eccentrically with respect to the axes of rotation 18 of the shafts 17, and that has a stable base formed by the frame comprising the longitudinal supports 20 and the transverse supports 22. In this base, the shafts 17 are rotatably supported that thus support the upper part 13 via the columns 27 and the longitudinal supports 20 and the lower part 15 via the gears that are formed by the shaft crank 25 and the connecting rods 23 respectively.

The above explanations generally also apply to the embodiment of FIGS. 4, 5 and 6 that show a lifting mechanism in accordance with the invention comprising only two shafts 17. The concept of the lifting mechanism in accordance with the invention and its arrangement and support in a rack of a respective working station, as described here, can generally be applied to any desired number of shafts 17 arranged behind one another in the longitudinal direction.

Figures 4A, 4B:
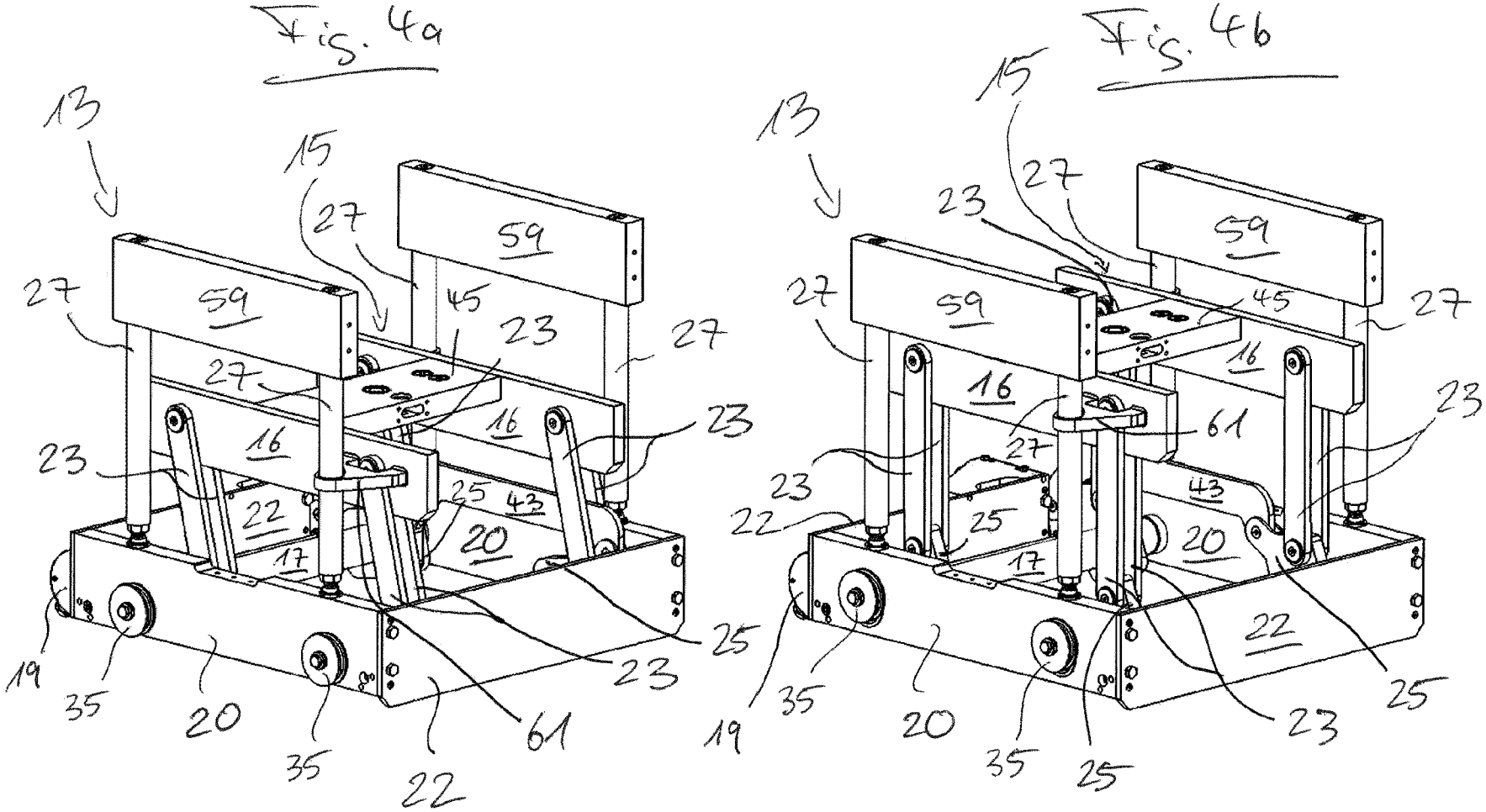
Figures 5A, 5B:
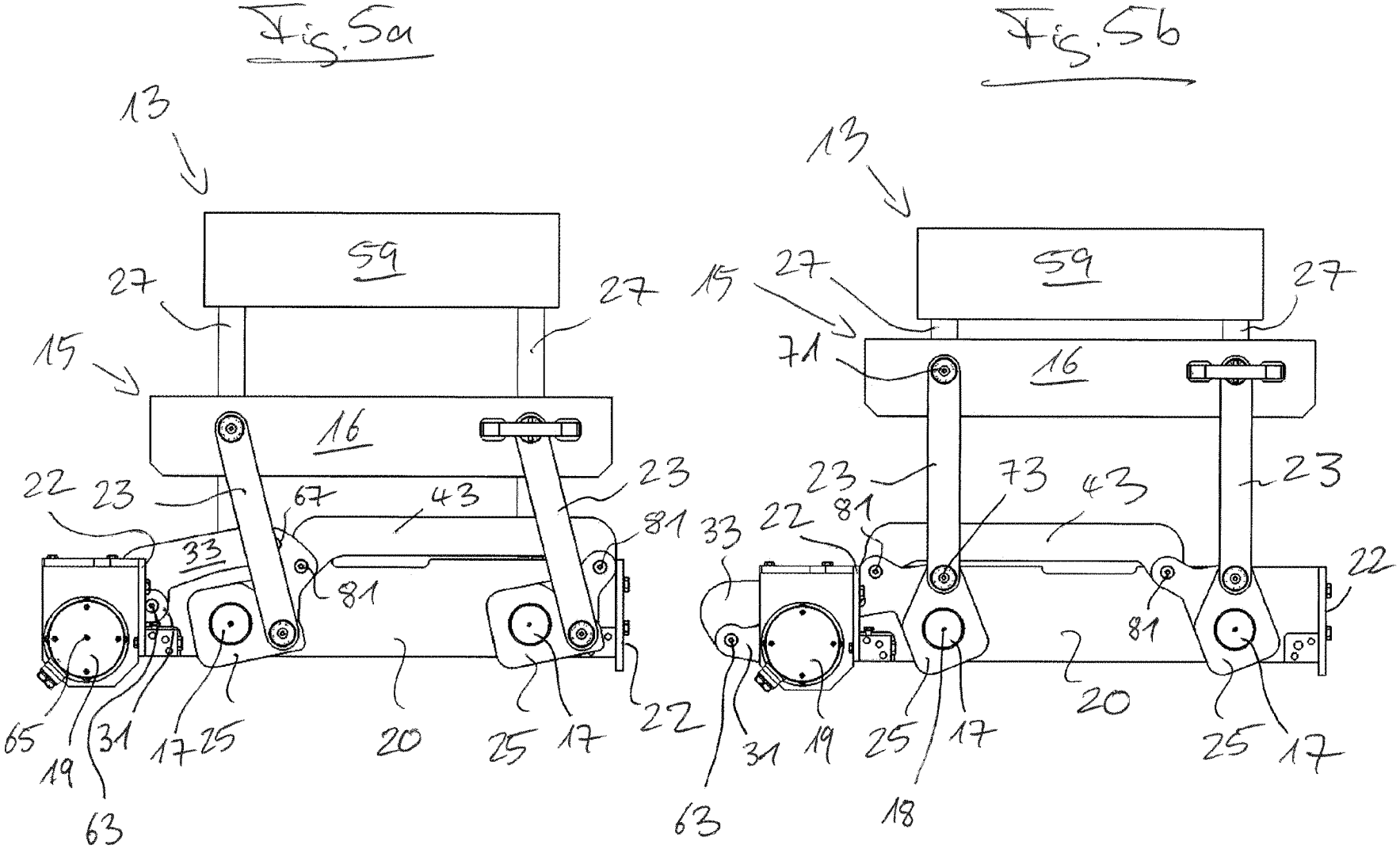
Figure 6B:
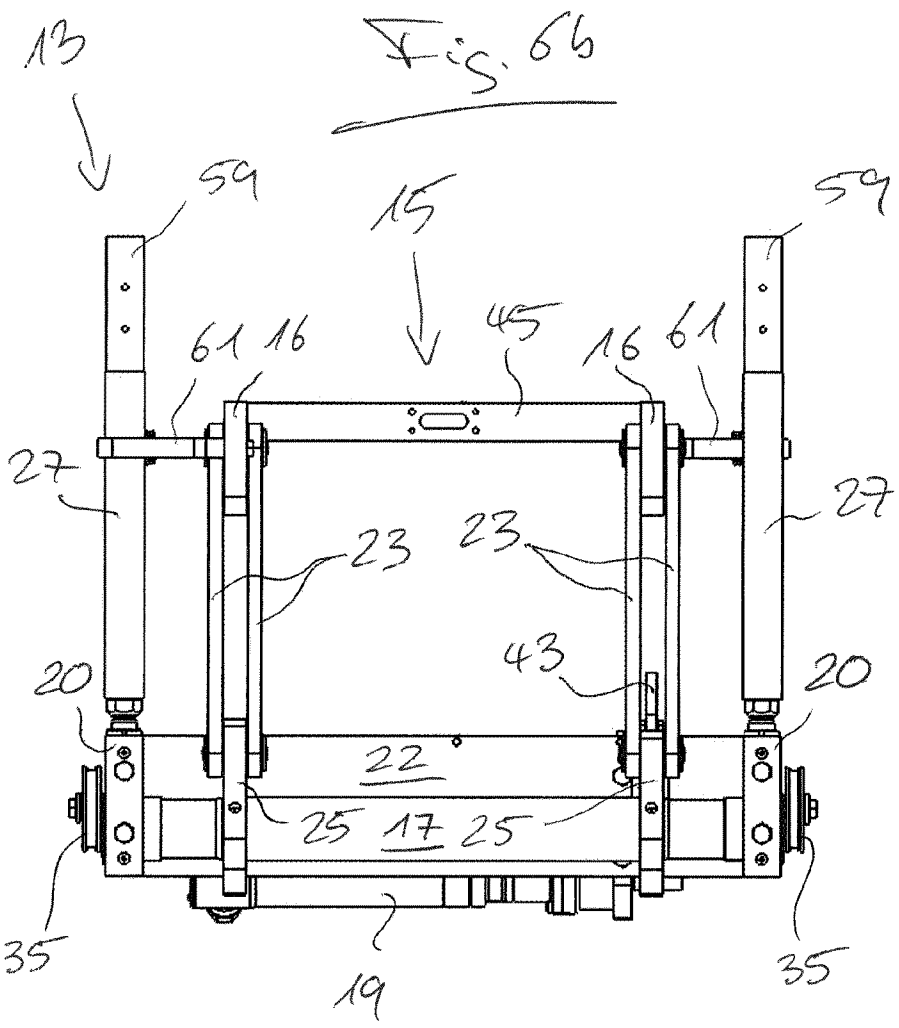
Figure 6A:
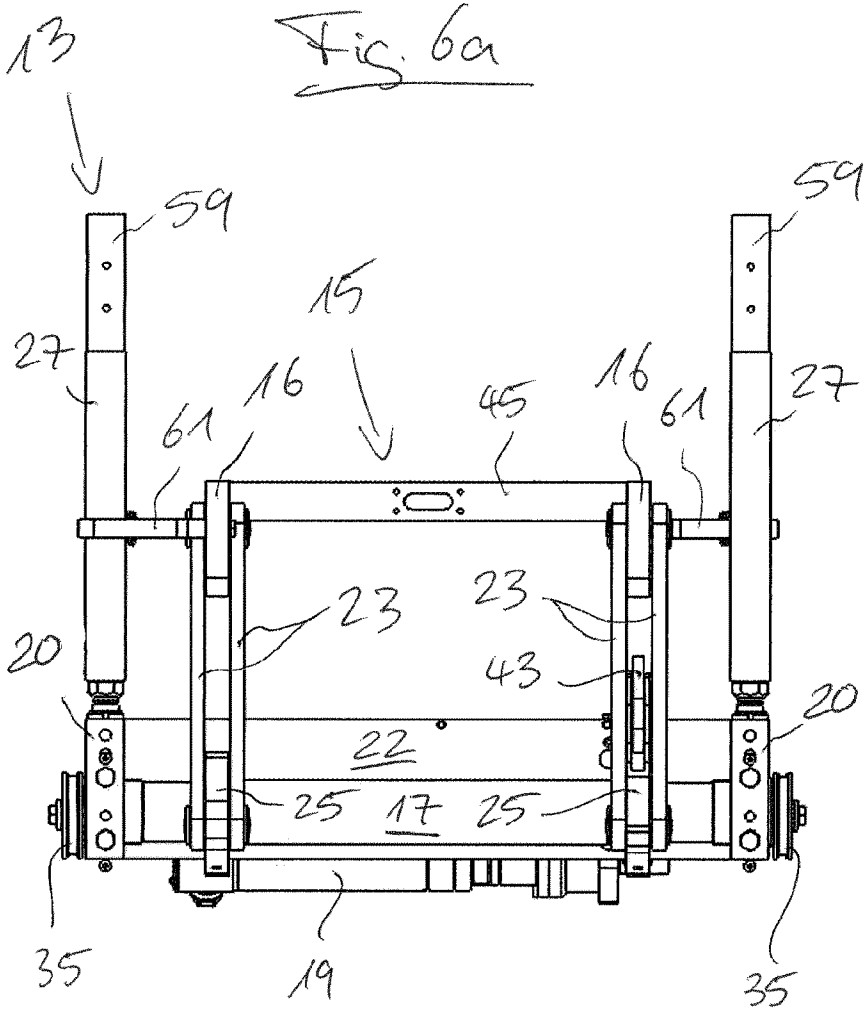

While the open state with the lower part 15 lowered to the maximum and the upper part 13 raised to the maximum is shown in FIGS. 4*a*, 5*a* and 6*a* respectively, FIGS. 4*b*, 5*b* and 6*b* respectively show the state of the lifting mechanism when the chamber is closed.

Furthermore, FIGS. 4 and 6 each show a plate-shaped transverse strut 45 for the lower part 15 connecting the two supports 16 of the lower part 15.

The supports 16 and the transverse strut 45 of the lower part 15 and the longitudinal members 59 of the upper part 13 represent functional blocks for the lower chamber and the upper chamber (not shown) and are provided with the electrical and pneumatic connectors and connections required for the operation of the working chamber.

Furthermore, the symmetrical design of the individual gears can in particular be seen from the representations in FIG. 6*a* and FIG. 6*b* in which the support 16 of the lower part 15 and the shaft crank 25 are arranged between the pair of connecting rods 23 in each case. This simplifies the design of the rotary supports between the connecting rods 23 and the support 16, on the one hand, and the connecting rods 23 and the shaft crank 25, on the other hand, since tilt torques and transverse forces resulting therefrom are avoided or at least minimized. The guide lugs 61 for the vertical guidance of the lower part 15 at the columns 27 can consequently be designed comparatively simply. This also underlines the extremely robust and low-maintenance total design of the lifting mechanism.

Furthermore, it can in particular be seen from the representations in FIGS. 4 and 6 that the movable parts for raising and lowering the lower part 15 as well as the rollers 35, eccentrically supported at the shafts 17, for supporting the total lifting mechanism at the rack and for performing the upper stroke are laterally arranged relatively far to the outside and are consequently easily accessible. In addition, the inner space of the lifting mechanism is hereby available for other purposes, in particular for tool-specific components and connection lines.

A further advantage of the lifting mechanism in accordance with the invention is that the integration of the upper stroke movement does not mean any significant additional effort, but only requires the explained eccentric connection between the shafts 17 and the support rollers 35 instead of a generally likewise possible central connection.

REFERENCE NUMERAL LIST

11 rack
13 upper part
15 lower part
16 support of the lower part
17 shaft
18 axis of rotation of the shaft
19 drive motor
20 longitudinal support
21 base, frame
22 transverse support
23 connecting rod
25 shaft crank
27 column
29 drive shaft
31 motor crank
33 drive coupling
35 support member, roller
36 eccentric axis
37 support section
39 spindle
41 spindle nut
43 synchronization coupling
45 transverse strut
51 support section
53 transverse member
55 film plane
57 foot
59 longitudinal member
61 lug
63 articulated axis
65 axis of rotation
67 articulated axis
71 articulated axis
73 articulated axis
81 articulated axis

The invention claimed is:

1. A working station for a packaging machine, comprising a rack supported on the ground;

a work unit comprising an upper part and a lower part; and a lifting mechanism which is carried by the rack and by which the lower part of the work unit can be raised and lowered relative to the rack to perform a lower stroke, wherein the lifting mechanism has a drive that comprises at least one shaft extending in a transverse direction; a drive motor engaging at the shaft for rotating the shaft; and at least one gear which is coupled at an input side to the shaft, at which the lower part is supported at an output side, and which converts a rotation of the shaft into the lower stroke of the lower part; wherein the shaft is carried by the rack at a first axial position of the shaft wherein the shaft carries a base at a second axial position of the shaft, the second axial position being offset from the first axial position along the extension of the shaft in the transverse direction; and wherein the base carries the upper part.

2. A working station in accordance with claim 1, wherein the base comprises a frame.

3. A working station in accordance with claim 1, wherein the gear is configured as a coupling gear.

4. A working station in accordance with claim 3, wherein the coupling gear is configured as a slider crank gear or as a centric slider crank gear.

5. A working station in accordance with claim 1, wherein the gear comprises a toggle lever arrangement.

6. A working station in accordance with claim 5, wherein the toggle lever arrangement is stretched in a position with the lower part raised to the maximum.

7. A working station in accordance with claim 1, wherein the gear comprises at least one pair of congruent and mutually spaced apart connecting rods between which a shaft crank rotationally fixedly connected to the shaft is connected in an articulated manner at the input side and the lower part or a support for the lower part is connected in an articulated manner at the output side.

8. A working station in accordance with claim 1, wherein the shaft is rotatably supported in longitudinal supports of the base that are spaced apart from one another in the transverse direction.

9. A working station in accordance with claim 1, wherein the gear comprises at least two individual gears that are spaced apart along the shaft and that are synchronized by means of the shaft for a joint performance of the lower stroke of the lower part.

10. A working station in accordance with claim 1, wherein the lifting mechanism comprises a plurality of synchronized shafts that are spaced apart along the rack and that each have a gear for the joint performance of the lower stroke of the lower part.

11. A working station in accordance with claim 1, wherein, during the lower stroke of the lower part, the lower part is guided at the base, at the upper part, or at a column supporting the upper part at the base.

12. A working station in accordance with claim 1, wherein the upper part is vertically adjustably supported at the base.

13. A working station in accordance with claim 1, wherein the upper part is supported at the base via a plurality of columns.

14. A working station in accordance with claim 1, wherein the drive motor engages at the shaft via a coupling gear.

15. A working station in accordance with claim 14, wherein, in a position with the lower part lowered to the maximum, the torque applied to a drive shaft of the drive motor via the coupling gear is zero or approximately zero.

16. A working station in accordance with claim 14, wherein the coupling gear is configured as a four-bar linkage that comprises a drive shaft of the drive motor; a motor crank connected to the drive shaft; a drive coupling connected in an articulated manner to the motor crank; and a shaft crank rotationally fixedly connected to the shaft and connected in an articulated manner to the drive coupling.

17. A working station in accordance with claim 16, wherein, in a position with the lower part lowered to the maximum the axis of rotation of the drive shaft of the drive motor, the articulated axis between the motor crank and the drive coupling, and the articulated axis between the drive coupling and the shaft crank lie at least approximately in one plane.

18. A working station in accordance with claim 1, wherein the base can be lowered and raised relative to the rack to perform an upper stroke of the upper part.

19. A working station in accordance with claim 18, wherein the lower stroke of the lower part and the upper stroke of the upper part are positively coupled to one another.

20. A working station in accordance with claim 18, wherein the upper stroke of the upper part and the lower stroke of the lower part extend in opposite senses to one another.

21. A working station in accordance with claim 1, wherein the lifting mechanism is adjustable relative to the rack in a longitudinal direction.

22. A working station in accordance with claim 1, wherein the lifting mechanism is supported via a plurality of support members at the rack and is adjustable relative to the rack in the longitudinal direction by means of the support members.

23. A working station in accordance with claim 1, wherein the rack has at least two support sections which extend spaced apart in parallel in the longitudinal direction, at which the lifting mechanism is supported, and along which the lifting mechanism is adjustable relative to the rack.

24. A working station in accordance with claim 1, wherein a fixing device is provided by means of which the position of the lifting mechanism in the longitudinal direction can be fixed at the rack.

25. A working station in accordance with claim 24, wherein the fixing device comprises a spindle drive for setting the longitudinal position of the lifting mechanism.

26. A working station in accordance with claim 25, wherein the spindle drive comprises a spindle attached to the rack; and a spindle nut, with the spindle nut preventing a movement of the lifting mechanism relative to the rack in the longitudinal direction and allowing said movement in a lift direction.

27. A working station in accordance with claim 1, wherein the working station is one of a deep-drawing station, a molding station, a sealing station, a cutting station or a punching station.

* * * * *